United States Patent [19]

Leurent

[11] 3,996,844

[45] Dec. 14, 1976

[54] OPENING SKYLIGHT OF GREAT STABILITY

[76] Inventor: Ghislain Leurent, 23 Avenue de la Marne Tourcoing, Tourcoing, France

[22] Filed: July 25, 1975

[21] Appl. No.: 598,927

[30] Foreign Application Priority Data

July 30, 1974 Belgium ..... 53776

[52] U.S. Cl. ..... 98/42 R; 98/66 R; 98/82; 52/200

[51] Int. Cl.[2] ..... F24F 7/02

[58] Field of Search ..... 52/198–200; 98/66 R, 82, 2.12, 2.14, 2.16, 35, DIG. 6, 42

[56] References Cited

UNITED STATES PATENTS

| | | | |
|---|---|---|---|
| 3,064,548 | 11/1962 | Field | 98/43 R |
| 3,399,500 | 9/1968 | Shapiro | 52/200 |
| 3,417,527 | 12/1968 | Kiekhaefer | 52/200 |
| 3,434,250 | 3/1969 | Kiekhaefer | 52/200 |
| 3,455,073 | 7/1969 | Kiekhaefer | 52/200 |
| 3,839,949 | 10/1974 | Gobel | 98/42 |

FOREIGN PATENTS OR APPLICATIONS

| | | | |
|---|---|---|---|
| 107,577 | 6/1967 | Denmark | 52/200 |
| 1,290,325 | 3/1969 | Germany | 52/200 |
| 2,034,083 | 1/1972 | Germany | 52/200 |

*Primary Examiner*—John J. Camby
*Assistant Examiner*—Henry C. Yuen
*Attorney, Agent, or Firm*—Bacon & Thomas

[57] ABSTRACT

The invention pertains to an opening skylight of great stability, more particularly of the type consisting of a fixed casing and of an opening part, the latter being itself made up of a frame and at least of one cupola, generally of transparent plastic material. The frame of the opening part comprises the combination of a first frame made up of tubular elements and of a second frame which is supported on the first one and cooperates with the latter for the attachment of the cupola or cupolas.

2 Claims, 11 Drawing Figures

OPENING SKYLIGHT OF GREAT STABILITY

This invention concerns a skylight of the type which consists of a fixed casing in the shape of a frame and of an opening part in the shape also of a frame, associated with a cupola generally made of some transparent synthetic material, such as for instance acrylic resin, but having the possibility of being made of any appropriate transparent, translucent or opaque material. The cupola might also be made of sheet iron or other sheets namely if the skylight is more particularly intended for ventilation purposes or for the evacuation of smoke.

More particularly still, the invention concerns such skylights of the opening type, i.e. in which the fixed casing and the opening part are linked together by hinges. It is highly important, namely, that the opening part should show a great stability or respectively a high resistance to distortion, when taking into account the stresses which may occur either due to extreme climatic variations, or accidentally, namely in open position, or finally due to the effects of inertia subsequent to the end of travel shock when the opening part is freed from its attachment, namely when the ambiant air exceeds the critical temperature.

The stability could of course be considerably increased for such skylights by the use of steel sections, or respectively constituent elements of greater size. However, certain limitations have to be taken into consideration which, from an economical and from a practical and esthetical point of view should not be surpassed.

A first purpose of the invention concerns the fabrication of such opening parts for skylights which satisfy the above-mentioned criteria, i.e. which can assure a maximum stability for the opening part, with a minimum of bulkiness and a novel esthetical appearance.

A further purpose of the invention conerns the fabrication of such skylights either with single or with double cupolas, without prejudice to the good resistance of the opening part to accidental distortions.

Finally, yet another purpose of the invention concerns, again without prejudice to the good stability of the opening part, the fabrication of skylights which assure a permanent ventilation. Consequently, a skylight according to the invention is essentially characterized by the fact that the frame of the opening part is built by means of an association of tubular section, in such a manner that, by the definition itself, the frame of the opening part offers a considerable moment of inertia in all directions, thus assuring a maximum stability of the skylight.

A second characteristic of the invention is to be found in the fact that the branches of aforesaid frame of tubular elements act as a support for a second frame which serves the purpose of an attaching element for the outer edges of the cupola. In a particular form of embodiment, spacers are inserted between the two frames which form the base of the cupola, in order to provide an evacuation of air from the inside towards the outside of the premises.

It thus becomes possible, with a minimum number of sections, to fabricate a wide range of skylights, all having a very great stability and boasting the possibility of being adapted for the applications under consideration.

Merely as a limiting example, forms of embodiment will be described hereinafter, with reference to the appended drawings in which.

Figure 1:
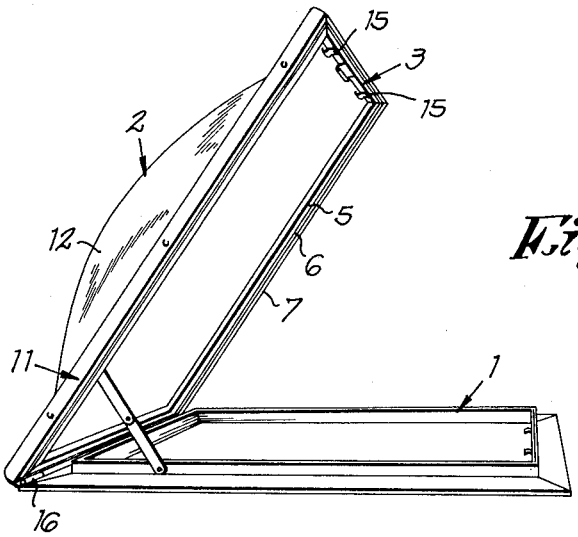
FIG. 1 shows a perspective view, in open position, of a skylight with single cupola, of the type according to the present invention.
Figure 2:
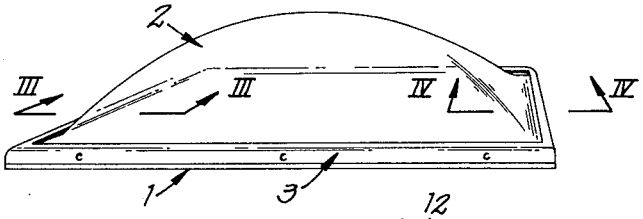
FIG. 2 shows a schematic view of the same skylight, in closed position.
Figure 3:
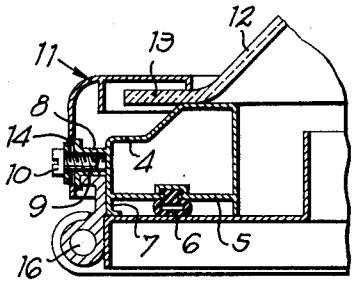
Figure 4:
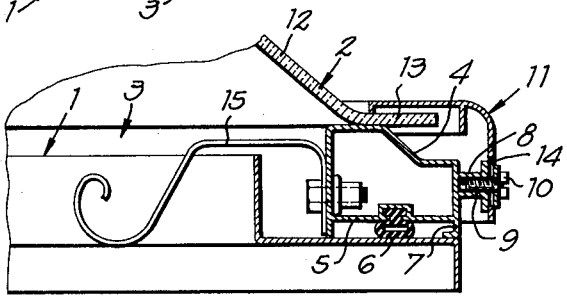
Figure 5:
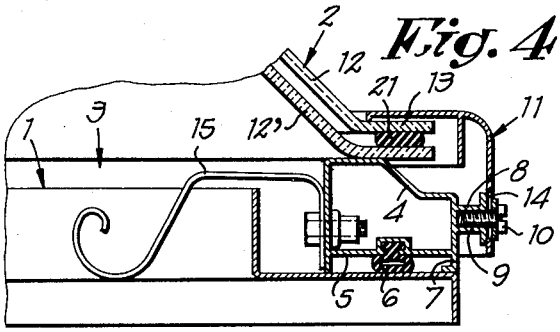
Figure 6:
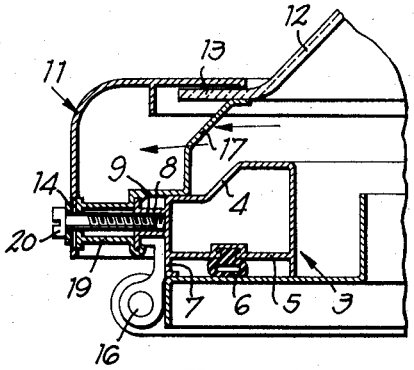
Figure 7:
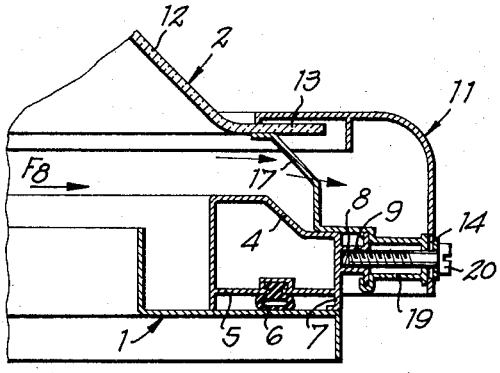
Figure 9:
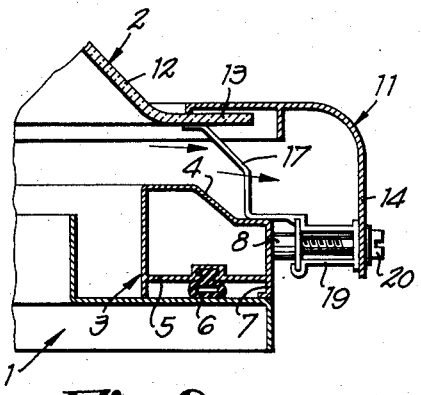
Figure 8:
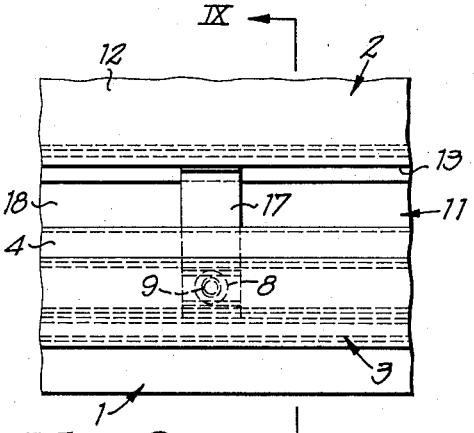
Figure 10:
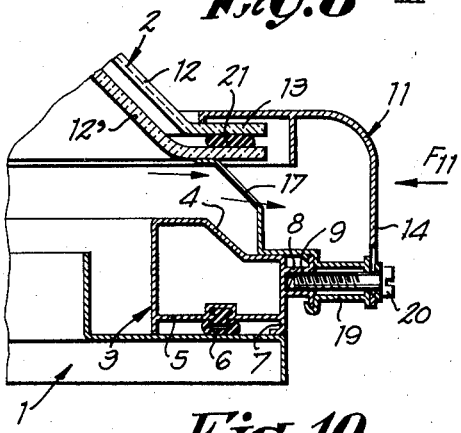
Figure 11:
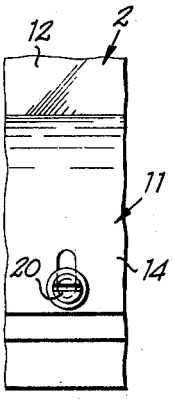

FIGS. 3 and 4 respectively show, to an enlarged scale, sections according to lines III—III and IV—IV in FIG. 2;

FIG. 5 is similar to FIG. 4, whereby the invention is applied to a skylight with double cupola;

FIGS. 6 and 7 are similar, respectively to FIGS. 3 and 4, but relating to the construction of a skylight with air circulation;

FIG. 8 shows a view in the direction of arrow F8 in FIG. 7;

FIG. 9 is a section according to line IX—IX of FIG. 8;

FIG. 10 is similar to FIG. 7 and relates to a skylight with double cupola;

FIG. 11 is a view in the direction of arrow F11 in FIG. 10.

In the form of embodiment according to FIGS. 1 to 4, a fixed casing 1 and an opening part 2 are shown. This fixed casing 1 may be constructed in any appropriate manner, and is made in the present case of lengths of a z-section.

According to the invention, the frame 3 of the opening part 2 is built up of box shaped sections 4 which can be supported on aforesaid frame of fixed casing 1. Sections 4, which are generally produced by extrusion, are provided along their bottom wall with a longitudinal groove into which is fitted a relatively elastic gasket 6. Aforesaid section 4 is also provided along its outer wall 7 with a longitudinal ridge 9, in which blind holes 9 are provided at intervals, these holes being threaded or not.

By means of screws 10 entered into aforesaid blind holes, a second frame 11 is attached, which cooperates with the lower tubular frame for solidly fixing the cupola 12, of which the outer edge is directed in one and the same plane. At the location of aforesaid blind holes 9, oblong holes 14 are provided in fixing frame 11, by means of which it becomes possible to adjust the positions of aforesaid second frame 11 in order properly to fix the cupola.

On the rear side of the tubular section which forms the front branch of the frame of the opening part, a shaped strap 15 is attached in order to permit manual displacement of the opening part by rotation about the hinges 16 which join the moving part to the fixed casing.

In FIG. 5, a similar layout to that of FIG. 4 is shown but in which the outer frame 11 is used for the construction of a skylight with a double cupola 12-12'.

In FIGS. 6 to 9, the construction of a skylight is shown by means of which air circulation is assured even when the skylight is in closed position. For this purpose, and whilst retaining in the present case all the characteristics of the skylight shown in FIGS. 1 to 4, in a general manner equally spaced strips 17 have been inserted between the tubular section 4 and the attachment frame 11, leaving free passages 18 between them which are extended by passages which separate the fixing locations of aforesaid second frame 11. These intermediate strips 17 are shaped in such a manner as to possess a hollow base 19, itself shaped so as to be able to be hooked to the longitudinal ridge 8 which is an integral part of tubular sections 4. Just as in the previous examples, aforesaid fixed frame 11 is solidly attached to tubular sections 4 by means of screws 20.

In FIG. 10, a construction is shown which is in accordance with FIGS. 6 to 8, but in which attachment frame 11 is adapted to be able to fix simultaneously two cupolas, respectively 12-12', with interposition of a gasket 21.

It is of course obvious that the possibility exists of modifying the shapes and dimensions of the various constituent elements of these skylights of great stability. They may also be completed by any accessory elements or devices.

The invention concerns both the aforesaid skylights of great stability and the various sections, generally made of aluminium by extrusion, and specially provided for the construction of such skylights.

What I claim is:

1. Skylight consisting of a fixed frame structure (1) delimiting an opening, a cover (2) hingedly connected to one side of said frame structure, said cover comprising a first (4) and a second (11) frame, at last one cupola (12) havng an edge portion (13), a plurality of supporting strips (17), and fixing means (20), first end portion of said supporting strips being secured to said first frame at locations spaced from each other by means of said fixing means in such a manner that second end portions of said supporting strips define a structure for supporting said edge portion of said cupola at a predetermined distance from said first frame and first end portions of said second frame being secured to said frame by means of said fixing means in such a manner that said first end portions of said second frame are located at a distance from said first frame and that second end portions of said second frame make contact with the upper surface of said edge portion whereby a continuously open air passage is provided by said distance between the first and second frames.

2. Skylight according to claim 1, wherein said first frame is constituted by tubular members having a ridge with spaced threaded holes made therein and wherein said second frame is built up by means of an L-shaped member one of the flanges of which has oblong holes made therein, said L-shaped member being secured to said tubular members by means of screws which pass through said oblong holes and which are screwed in said threaded holes, the other flange of said L-shaped member supporting said edge portion of said cupola and said oblong holes being able to adjust the position of said L-shaped member with respect to said tubular members, said one and other flanges constituting said first and second end portions of said second frame and said screws constituting said fixing means.

* * * * *

UNITED STATES PATENT OFFICE

CERTIFICATE OF CORRECTION

PATENT NO. : 3,996,844

DATED : December 14, 1976

INVENTOR(S) : GHISLAIN LEURENT

It is certified that error appears in the above-identified patent and that said Letters Patent are hereby corrected as shown below:

The number of the Belgium priority document should read: "2/53776".

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*